US005888180A

United States Patent [19]

Dewberry

[11] Patent Number: 5,888,180

[45] Date of Patent: Mar. 30, 1999

[54] WEIGHT LIFTING SUPPORT AND CUSHION DEVICE

[76] Inventor: Bishop A. Dewberry, 5103 S. Sheridan Suite 343, Tulsa, Okla. 74145

[21] Appl. No.: 749,530

[22] Filed: Nov. 15, 1996

Related U.S. Application Data

[60] Provisional application No. 60/006,930 Nov. 17, 1995.

[51] Int. Cl.[6] ..... A63B 21/00; A41D 19/00

[52] U.S. Cl. ..... 482/139; 482/106; 482/108; 2/161.1; 2/162; 2/170; 224/221; 294/149

[58] Field of Search ..... 482/23, 33, 38, 482/49, 50, 105, 106, 108, 139; 294/25, 149, 150, 164, 165, 156; 602/21, 64; 2/17, 161.1, 162, 170; 224/219, 221, 250, 267; 441/69

[56] References Cited

U.S. PATENT DOCUMENTS

| | | | |
|---|---|---|---|
| D. 256,401 | 8/1980 | Adams . | |
| 4,720,279 | 1/1988 | Fritschen et al. . | |
| 4,756,527 | 7/1988 | Ledbetter | 482/139 |
| 4,807,876 | 2/1989 | Lothar . | |
| 4,809,974 | 3/1989 | Buhr . | |
| 5,004,231 | 4/1991 | Alread . | |
| 5,090,691 | 2/1992 | Pollock | 482/139 |
| 5,182,814 | 2/1993 | Christensen . | |
| 5,353,440 | 10/1994 | Meldeau . | |

*Primary Examiner*—Richard J. Apley
*Assistant Examiner*—Victor K. Hwang
*Attorney, Agent, or Firm*—Scott R. Zingerman

[57] ABSTRACT

A weight lifting support and cushion device for attachment to a user's hand and a hand grippable portion of an exercise device, such as, for example, an exercise or weight lifting bar. This weight lifting support and cushion device includes two double overlay straps, a prop brace, a recoil tip, foundational connector, and a split cushion support system. The device could be worn on either the left or the right hand of the user; and in instances where both hands are required to grip the exercise device, a weight lifting support and cushion device will be worn on both hands. The two double overlay straps are secured to the prop brace on their first ends and extend substantially parallel until they converge at the recoil tip. The foundational connector has looped ends through which a double overlay strap is inserted so that the double overlay straps together slide freely within the looped ends of the foundational connector. In use, the hand is inserted past the prop brace through the foundational connector so that the recoil tip is adjacent the fingers or palm of the hand and the foundational connector extends around the back of the wrist. Two split cushion supports are fixed to the foundational connector so as to cushion the sides and back of the hand. The recoil tip is formed by rolling the second ends of the double overlay straps and securing that roll by a cover strap.

12 Claims, 3 Drawing Sheets

12
14
60
64
66
62

12
14
64
66
63
60

12
14
64
66
18
63
68
60
70

28
26
22
54
50
52
20
56
24
10

WEIGHT LIFTING SUPPORT AND CUSHION DEVICE

This application claims the benefit of the following:

U.S. Provisional Application Ser. No. 60/006,930, filed Nov. 17, 1995.

BACKGROUND OF THE INVENTION

This invention relates to devices used to grip an exercise device and support the wrist and hand during exercise.

BACKGROUND OF THE INVENTION

Various types of exercise devices and machines are commonly used to obtain muscle mass, strength, tone, and definition. These devices commonly provide forces which resist movement by a user wherein the user, or weight lifter, works against these resistive forces repetitively over time to work various muscle groups of the body. This exercise/training equipment is well known in the art wherein the most common equipment providing resistive forces provided by weights, pulleys, springs, or combinations thereof.

Generally working out the muscle groups of the upper body is accomplished by gripping some sort of bar with one or both hands and working against a resistive force, either by pulling or pushing in a plurality of directions. Gripping and repetitively working against a resistive force by gripping an exercise bar with the user's hand may weaken the hand, possibly rendering the user unable to continue with a workout. Additionally, the application of resistive force against the hand or wrist may result in areas of concentrated pressure on the hand or wrist, i.e. pressure points.

Known devices in the industry developed to cushion, support, and/or improve the grip of a user's hand on an exercise device include gloves, straps, and rigid devices such as plastic or metal hooks which are secured to the user's hands to contact the exercise device.

Gloves presently available provide some support and cushion; however, they are generally tight and difficult to put on and remove. Gloves also limit hand motion during periods between repetitions. Being enclosed and tight during workouts, gloves also generally cause the hand to sweat inside the glove.

Various types of straps are available which secure around the wrist and/or hand and then are tied or wrapped around the portion of the exercise device to be gripped by the user's hand. While strap devices allow freedom of hand motion and do not cause the hand to sweat like gloves, they do not cushion the entire hand or wrist against the exercise device. Two additional significant problems encountered by the user of exercise straps include the fact that they constrict around the wrist or hand of the user, dig into the skin of the hand or wrist, and uncomfortably stretch the skin of the wrist or hand during use. A further significant problem encountered with the use of exercise straps includes the fact that when the strap is wrapped or twisted around the bar and hand of the user, they tend to pull or place pressure upon the wrist or hand in a direction other than in alignment with the fingers and arm of the user. This means that during use, when the strap is used to push or pull an exercise device such as a weight lifting bar, the user feels an unnatural pull from the strap other than in alignment with the fingers or arms generally held perpendicular to the weight lifting bar. A need therefore exists in the art for a device that supports in the natural direction aligned with the fingers and arms of the user.

Rigid devices constructed of metal, plastic, foam, or combinations thereof, are designed to provide support and comfort to the hand and wrist of the user by distributing the weight of the exercise bar, generally metal, over the entire palm. These devices are generally strapped onto the wrist of the user. Problems encountered with these devices are that the user loses contact with the bar and is unable to securely grip the bar as well as loses the feel of the exercise bar in the hand. Additionally, as with strap devices, these straps generally constrict the wrist as well as pull and dig into the skin of the hand and wrist.

Other available devices designed to assist the user in gripping the exercise device include means such as a dowel or short cylindrical piece of metal encased in a strap that is wrapped around the bar to assist in the grip of the exercise bar. Problems associated with such devices include the fact that the dowel or cylindrical metal rod places a concentrated pressure point in the palm of the hand, causing the hand to tire more rapidly.

A need, therefore, exists for an exercise device which cushions and supports the hand and wrist, that is easy to put on and remove, that allows the hand and wrist to move freely between repetitions, and does not cause the hand to sweat.

A need also exists for an exercise device which enhances the user's ability to grip the exercise bar without causing excess pressure on the user's hand at a concentrated location.

SUMMARY OF THE INVENTION

This invention is a weight lifting support and cushion device for attachment to a user's hand and wrist and a hand gripable portion of an exercise device, such as, for example, an exercise or weight lifting bar. The weight lifting support and cushion device includes two double overlay straps, a prop brace, recoil tip, foundational connector, and a split cushion support system. The device can be worn on either the left or right hand of the user; and in instances where both hands are required to grip the exercise device, a weight lifting support and cushion device will be worn on both hands. This is so that both hands and wrists can be supported and cushioned during exercise.

The two double overlay straps extend from the prop brace on their first end and are rolled inside a cover strip to form a recoil tip on their second end. The double overlay straps provide the ability to be wrapped around and cover the exercise bar so that the palm of the hand and the index finger, middle finger, ring finger, and pinky are all cushioned against the exercise bar, generally made of metal. Additionally, the pair of double overlay straps provide significant strength to the device.

When wrapped around the bar, the double overlay straps provide a flat cushion between the user's hand and the exercise bar so that there are no pressure points against the palm or fingers as a result of strap thickness or overlap. Since the double overlay straps are flexible, they not only provide cushion, but when tightened around the bar, they allow the hand to securely grip the bar and allow the user's hand to maintain a constant feel of the bar when gripped.

The double overlay straps are the same length and extend in parallel fashion from the wrist or base on the palm and converge in an inverted "V" shape at the fingertips. This provides an aligned or balanced effect when the double overlay straps are wrapped around the exercise bar. This is significant because when the double overlay straps are pulled tightly around the exercise bar, the direction of that force is in alignment with the longitudinal axis of the hand. Since for most exercises the arm is positioned perpendicular to the exercise bar, the fact that the pulling force of the double overlay straps is in alignment with the longitudinal axis of the hand, provides a feel to the user which is consistent with the natural gripping force of the hand and arm on the exercise bar.

When the balanced double overlay straps are rolled around the exercise bar, the recoil tip is inserted through or up to the inverted "V" formed by the convergence of the two double overlay straps, effectively locking the weight lifting support and cushion device to the exercise bar, from which force may be applied to the exercise bar directly from the wrist. This supports the wrist and hand of the user.

The prop brace is secured to the first ends of the double overlay straps. The prop brace functions to brace the inside wrist and lower palm and support the double overlay straps when the user's hand is inserted in the device and the device is locked onto an exercise bar. The prop brace is also used for removal of the weight lifting support and cushion device.

The foundational connector partially surrounds the wrist of the user so as to secure the device to the hand. The foundational connector includes looped ends which surround the double overlay straps, allowing the double overlay straps to slide freely therein. When the hand is inserted through the foundational connector and the device is tightened onto the arm of the user, the fact that the looped ends of the foundational connector surround the double overlay straps and are not secured to one another provides an important feature of the invention. When tightened, the looped ends of the foundational connector overlay the padded portions at the ball of the thumb and heel of the palm on the lower hand. In this way the foundational connector does not constrict the wrist of the user, nor does it pull or dig into the skin of the wrist. It also distributes the force of the exercise bar onto the padded portions of the palm.

The fact that the double overlay straps easily slide through the looped ends of the foundational connector provide ease in insertion and removal of the hand. This glide system provides significant ease of use of the device. In use, when a hand is inserted into the device and the double overlay straps are pulled tight so that the prop brace contacts the looped ends of the foundational connector, the device is secured to the hand but does not restrict movement of the wrist or hand.

The split cushion support system includes at least two split cushion supports positioned on the foundational connector and centered to support the back of the wrist. The split cushion supports are padded and folded around the foundational connector in the direction of the fingers of the user. In this way, the split cushion supports not only cushion the back of the wrist and hand from the foundational connector from the underside, they also protect the wrist and hand from the edge of the foundational connector which may otherwise contact the skin during use.

The recoil tip is a roll of material constructed from the second ends of the double overlay straps folded and secured by an interlocking cover strip. The shape of this recoil tip allows it to be inserted past or up to the double overlay straps when wrapped around the exercise bar so as to lock the device to the bar and also is cushioned so as to be held firmly in place by the user's fingers against the palm of the hand without causing a concentrated pressure point.

In use, the hand of the user, a weight lifter, for example, is inserted into the looped foundational connector past the prop brace so that the recoil tip is adjacent the fingers or the palm of the hand depending upon the size of the user's hand. Once the hand is inserted, the recoil tip is pulled in the direction of the fingertips until the prop brace contacts the looped ends of the foundational connector and the bony portion at the base of the wrist of the user's hand. In this way, when the device is secured to an exercise bar, and tightened thereto, pressure that is derived from pulling the foundational connector against the wrist is directed into the padded split cushion support and the ball of the thumb and heel of the palm.

Once the device is installed on the hand of the user, the double overlay straps are wrapped around the exercise bar and the recoil tip is inserted between or up to the double overlay straps, thereby locking the double overlay straps onto the exercise bar. Since the double overlay straps extend through or up to the looped ends of the foundational connector and secured by the prop brace, this secures the device and the hand of the user tightly to the exercise bar.

It is an object of this invention to provide a weight lifting support and cushion device which cushions and supports the wrist and hand of a user but does not constrict the wrist, or cut into or pull the skin of the hand.

It is another object of this invention to provide a device which allows the user's hand to securely grip an exercise bar without causing pressure points in the wrist or hand.

A further object of the present invention is to provide a weight lifting support and cushion device which can be put on and removed easily.

A yet further object of the present invention is to provide a weight lifting support and cushion device which does not restrict movement of the wrist and hand or cause the hand to sweat.

A still yet further object of the present invention is to provide a weight lifting support and cushion device which is balanced to provide support in alignment with the longitudinal axis of the hand and added strength of the device.

These and other objects will become more apparent from the following description taken in conjunction with the drawings.

DETAILED DESCRIPTION OF THE PREFERRED EMBODIMENT

Figure 1:
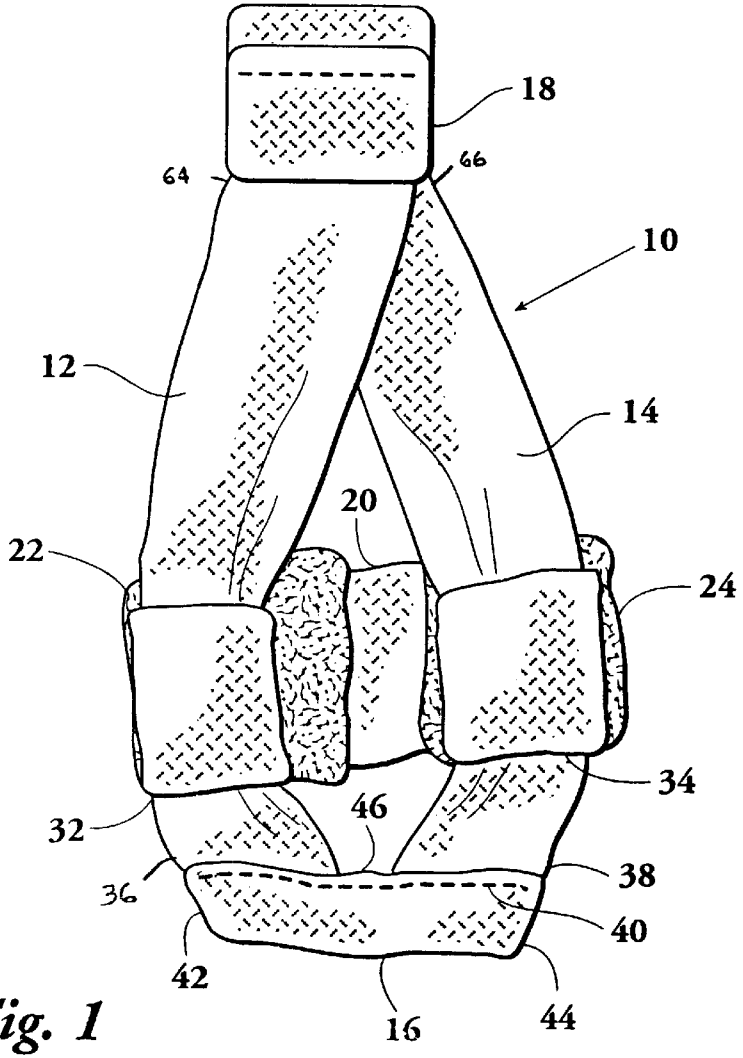
FIG. 1 is a top view of the weight lifting support and cushion device of the present invention.

Attention is first directed to FIG. 1 which is a top view of the weight lifting support and cushion device 10 of the present invention. Weight lifting support and cushion device 10 includes generally double overlay straps 12 and 14, prop brace 16, recoil tip 18, foundational connector 20, and split cushion supports 22 and 24. Weight lifting support and cushion device 10 is designed to be worn on the hand of a person during exercise, such as for example weight lifting and can be worn on the right or left hand. In most cases, a second support and cushion device 10 would be worn on the exerciser's other hand so that both hands can be supported and cushioned during exercise. In the preferred embodiment, the double overlay straps 12 and 14, prop brace 16, recoil tip 18, and foundational connector 20 are constructed of 100% cotton webbing while split cushion supports 22 and 24 are constructed of neoprene. It is understood, however, that many other materials are suitable alternatives for the construction of these components. Examples of suitable alternatives include nylon, propylene, elastic, leather, or rubber.

Figure 2:
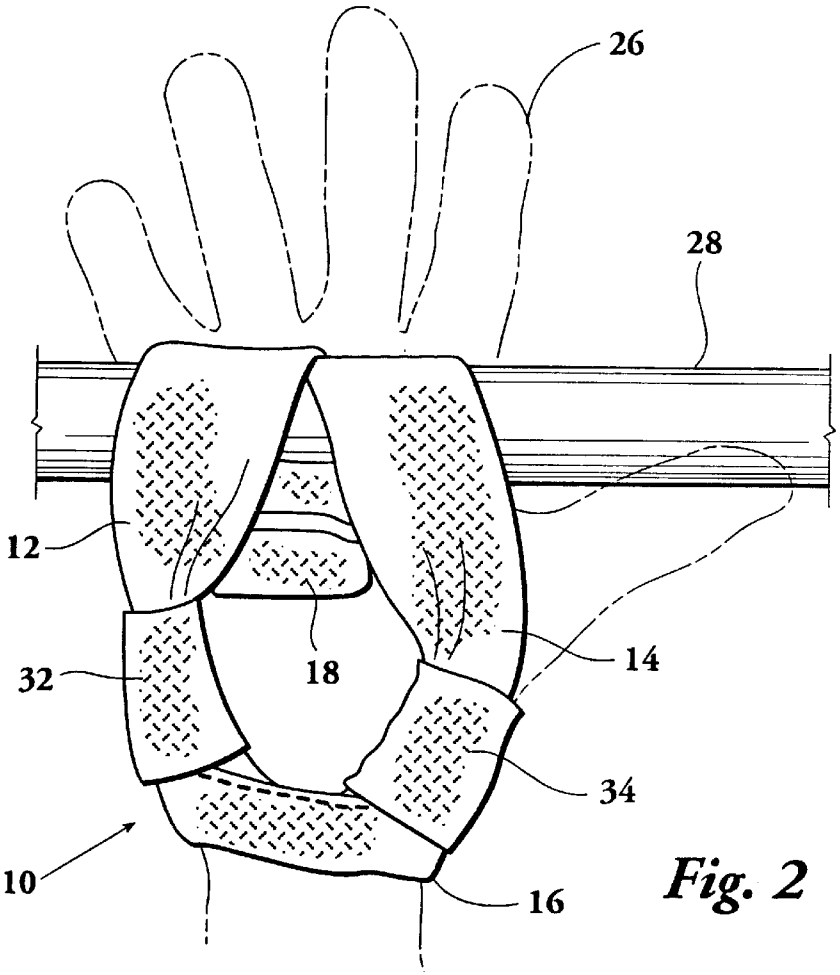
FIG. 2 is a front view of the weight lifting support and cushion device of the present invention shown on the hand of a weight lifter and wrapped around an exercise bar.

In use, the foundational connector 20 is positioned halfway between prop brace 16 and recoil tip 18 so as to allow looped ends 32 and 34 of foundational connector 20 to be spread apart the maximum distance allowed by the flexible double overlay straps 12 and 14 respectively. Spreading apart looped ends 32 and 34 of foundational connector 30 allows a hand of the weight lifter to be inserted past prop brace 16 and between foundational connector 20 and double overlay straps 12 and 14. The hand of the weight lifter is inserted so that recoil tip 18 is adjacent the fingers or palm of the hand. Once inserted, recoil tip 18 is pulled in the direction of the fingertips of the hand, thereby sliding double overlay straps 12 and 14 through looped ends 32 and 34 of foundational connector 20 until looped ends 32 and 34 contact prop brace 16 and prop brace 16 contacts the padded portion of the base of the palm of the hand of the weight lifter. In this way pressure derived from pulling support and cushion device 10 against the wrist is directed into the padded ball of the thumb and heel of the palm. This position is substantially shown in FIG. 2 wherein double overlay straps 12 and 14 are wrapped over and around exercise bar 28. FIG. 2 depicts the proper orientation of weight lifting support and cushion device 10 on hand 26 (shown in phantom) wherein double overlay straps 12 and 14 are wrapped over and around exercise bar 28.

Figure 3:
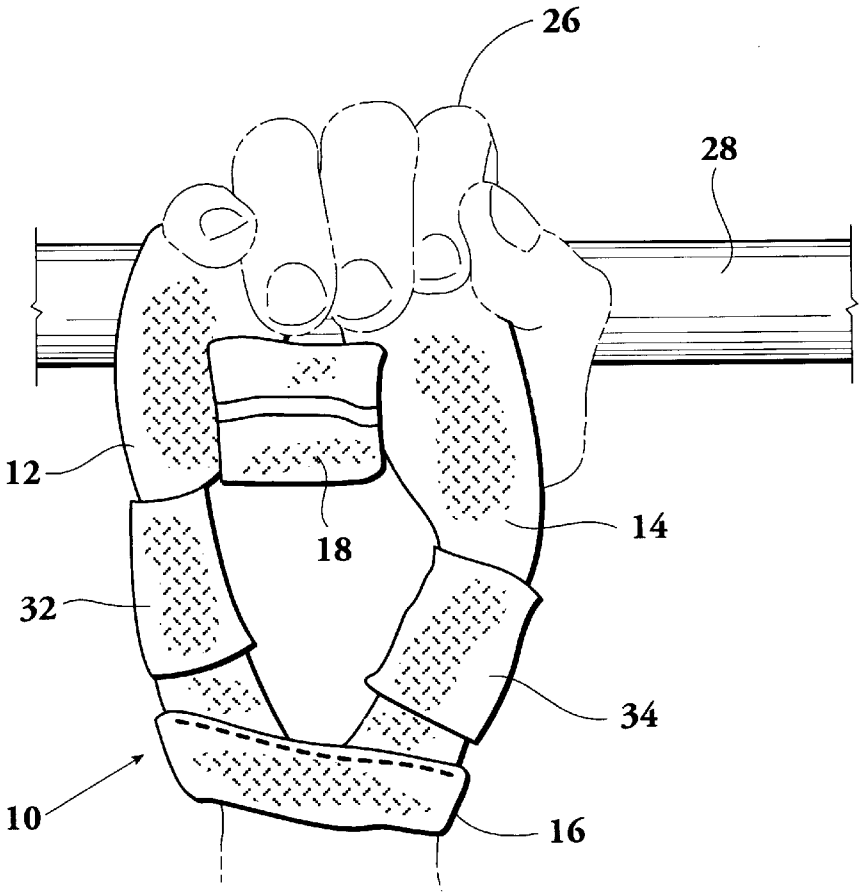
FIG. 3 is a front view of the weight lifting support and cushion device of FIG. 2 wherein the device is shown locked onto the exercise bar and gripped by the hand of the weight lifter.

Referring to FIG. 3, recoil tip 18 is then inserted through or up to the inverted "V" where double overlay straps 12 and 14 converge and double overlay straps 12 and 14 are pulled tightly around exercise bar 28, thereby locking weight lifting support and cushion device 10, hand 26, and exercise bar 28 together. In this way, weight lifting support and cushion device 10 provides cushion between hand 26 and exercise bar 28, allows hand 26 to securely grip exercise bar 28, and supports the palm and wrist of hand 26.

Hand 26 may be released by pushing recoil tip 18 from between double overlay straps 12 and 14 and unwrapping double overlay straps 12 and 14 from exercise bar 28. In this position the fingers and wrist of hand 26 may move freely in any direction. In order to remove weight lifting support and exercise device 10 from hand 26, prop brace 16 is gripped and pulled toward the elbow of the arm. Pulling prop brace 16 thereby pulls double overlay straps 12 and 14 through looped ends 32 and 34 of foundational connector 20. Foundational connector 20 is then spread apart, and hand 26 is easily removed.

Although FIGS. 2, 3, 4, and 5 depict right hand 26, it is understood that weight lifting support and cushion device 10 operates identically on a weight lifter's left hand.

Referring back to FIG. 1, double overlay straps 12 and 14 extend from prop brace 16 on first ends 36 and 38 respectively and are rolled inside a cover strip to form recoil tip 18 on second ends 64 and 66. The manner in which the second ends, 64 and 66 of double overlay straps 12 and 14 are rolled to form recoil tip 18 is discussed below in greater detail with regard to FIGS. 6, 7, and 8.

Double overlay straps 12 and 14 provide the ability to cover the exercise bar so that the palm of the hand is protected from the bar, generally made of metal. When wrapped around the bar, as shown in FIG. 2, double overlay straps 12 and 14 provide a flat cushion between the weight lifter's hand 26 and the exercise bar 28 so that there are no pressure points against hand 26 as a result of strap thickness or overlap. Since double overlay straps 12 and 14 are flexible, they provide grip and cushion between hand 26 and exercise bar 28 and allow hand 26 to maintain constant "feel" of the bar when gripped (as shown in FIG. 3).

Double overlay straps 12 and 14 are approximately 1½ inches wide and 10 inches long in the preferred embodiment. Although these dimensions are suitable for most weight lifters, it is understood that the width and/or length could be varied to accommodate variations in hand size of the weight lifter and/or variations in the diameter of the exercise bar. Since there are two double overlay straps 12 and 14, weight lifting support and cushion device 10 is capable of supporting significant weight. However, variations in the dimensions of double overlap straps 12 and 14 will vary the amount of weight or pressure device 10 can support.

In an alternate embodiment, double overlay straps 12 and 14 may be constructed from a single length of material folded to form a first length and a second length thereby eliminating prop,brace 16. The first length extends through the first looped end of foundational connector 20 and the second length extends through the second looped end of foundational connector 20. In this alternate embodiment, the terminal end of the first length is connected to the terminal end of the second length. These terminal ends may also be rolled ant sewn to form recoil tip 18 or rolled and sewn inside a cover strap to form recoil tip 18.

Double overlay straps 12 and 14 extend substantially parallel from prop brace 16 until they converge in an inverted "V" and are of the same length or "balanced" (FIG. 1) such that an axis can be drawn which bisects prop brace 16 and recoil tip 18 which substantially divides weight lifting support and cushion device 10 in half along its longitudinal axis. This is important when a hand 26 (FIG. 3) is inserted into weight lifting support and cushion device 10 and double overlay straps 12 and 14 are wrapped around exercise bar 28 such that recoil tip 18 is up to or inserted through or "locked" into double overlay straps 12 and 14 and onto exercise bar 28. In this manner weight lifting support and cushion device 10 is balanced so as to evenly support and distribute the weight of exercise bar 28 when exercise bar 28 is either pushed, such as for example, in a bench press exercise, or pulled, such as for example, in a pull-up exercise. The balanced double overlay straps 12 and 14 thereby provide support aligned along the longitudinal axis of hand 26.

Balanced double overlay straps 12 and 14 (FIG. 3) when rolled around exercise bar 28 allow recoil tip 18 to be inserted up to or between the inverted "V" formed by the convergence of double overlay straps 12 and 14. This insertion of recoil tip 18 effectively locks weight lifting support and cushion device 10 to exercise bar 28 so as to allow force on exercise bar 28 directly from the wrist. Support of hand 26 is derived from this feature.

Prop brace 16 is a length of material approximately 3 inches long and 1½ inch wide which is folded in half along its length around first end 36 of double overlay strap 12, and first end 38 of double overlay strap 14. Prop brace 16 is secured to first ends 36 and 38 by a stitch 40 along the length of prop brace 16. The terminal ends 42 and 44 of prop brace 16 as well as first ends 36 and 38 of double overlay straps 12 and 14 are trimmed to provide a tapered appearance as double overlay straps 12 and 14 extend from prop brace 16 to recoil tip 18. It is understood that the length and width of prop brace 16 may be varied as desired to accommodate the size of the wrist of the weight lifter. However, in the preferred embodiment, prop brace 16 is of a length such that a gap or space 46 is present between first ends 36 and 38 of double overlay straps 12 and 14 respectively. Space 46 allows prop brace 16 to be gripped by the weight lifter as necessary to position foundational connector 20 along double overlay straps 12 and 14 for either insertion or removal of hand 26 (FIG. 2) into weight lifting support and exercise device 10.

Figure 4:
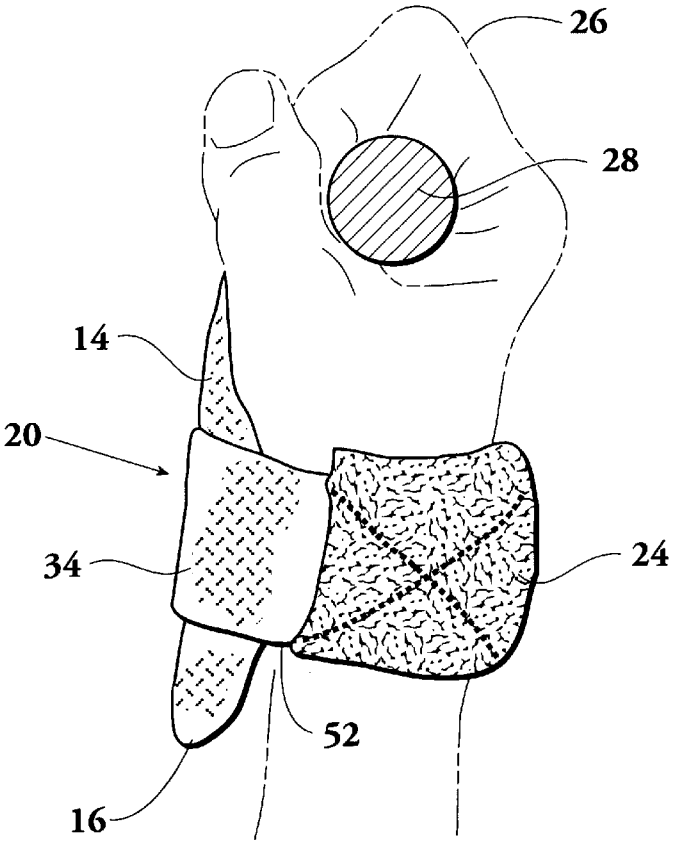
FIG. 4 is a side view of the weight lifting support and cushion device of FIG. 3.

Foundational connector 20 in the preferred embodiment is a length of 100% cotton webbing approximately 16" long and 1½ inches wide. As discussed above, the length and width of foundational connector 20 could be varied without departing from the spirit and scope of the present invention to accommodate various sizes of weight lifter's wrists and hands. In constructing weight lifting support and cushion device 10, one end of foundational connector 20 is folded around double overlay strap 12 and stitched, forming looped end 32. Similarly, the other end of foundational connector 20 is folded around double overlay strap 14 and stitched to form looped end 34. FIG. 4 shows stitch 52 in foundational connector 20 forming looped end 34 from a side view.

Figures 5, 6, 7, 8:
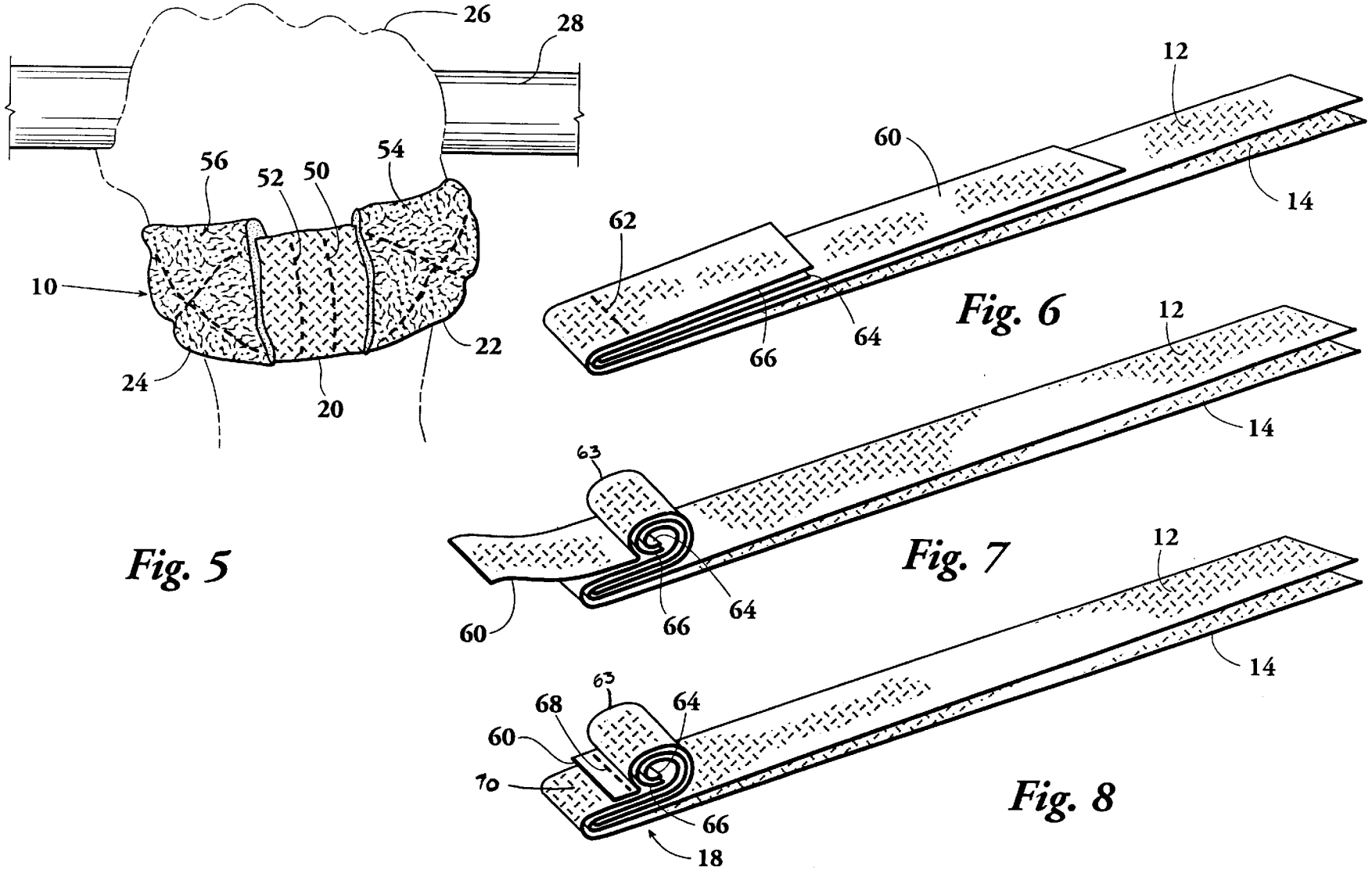
FIG. 5 is a back view of the weight lifting support and cushion device of FIG. 3.
FIG. 6 is an isometric view depicting the double overlay straps folded over the cover strip and stitched in the construction of the recoil tip of the present invention.
FIG. 7 is the isometric view of FIG. 6 wherein the portion of the double overlay straps folded over the cover strip is rolled back toward the stitch to make a roll, and the cover strip is folded over that roll in the construction of the recoil tip of the present invention.
FIG. 8 is the isometric view of FIG. 7 wherein the cover strip, which is folded over the roll, is stitched and its excess cut off to form the recoil tip of the present invention.

Referring to FIG. 5, the ends of foundational connector 20 are folded back and stitched by foundational connector stitches 50 and 52 on the inside back of foundational connector 20.

Foundational connector 20 secures weight lifting support and cushion device 10 to the wrist of the weight lifter (FIGS. 2, 3, and 5) without constricting the wrist of hand 26. Referring to FIG. 3, in use, looped ends 32 and 34 overlay and support hand 26 by helping distribute pressure on hand 26 by the weight of exercise bar 26 into the padded portions at the ball of the thumb and heel of the palm at the lower palm of hand 26 for support and comfort.

Another advantage of foundational connector 20 is that double overlay straps 12 and 14 slide easily through looped ends 32 and 34 respectively for easy insertion and removal of hand 26. In this way, foundational connector 20 supports and aids in the distribution of weight around hand 26 as well as supports and aids in the installation and removal of weight lifting support and cushion device 10 without constricting, pulling, or pinching the wrist of hand 26. Foundational connector 20 thereby provides significant advantages to the present invention.

Referring back to FIG. 1, split cushion supports 22 and 24 provide a cushion between foundational connector 20 and the sides and back of hand 26. Split cushion supports 22 and 24 are each approximately three inches (3") long, two inches (2") wide, and one-eighth inch (⅛) in the preferred embodiment. Split cushion supports 22 and 24 are preferably constructed of neoprene. Neoprene #R1490-N with fabric outside and skin inside, available from Rubatex Corporation is particularly suitable for this purpose although other padded materials could be substituted. The dimensions of and material used in the construction of split cushion supports 22 and 24 could vary, depending upon the length of foundational connector 20, the size of the wrist and hand of the weight lifter, and the intended use of the device. As can be seen in FIG. 5, a back view of the weight lifting support and cushion device 10 of the present invention, split cushion supports 22 and 24 are folded along their length around foundational connector 20 so that there is a gap between split cushion supports 22 and 24. Split cushion supports 22 and 24 are sewn onto foundational connector 20.

Split cushion supports 22 and 24 are folded over foundational connector 20 such that folds 54 and 56 are directed toward hand 26. This is significant. Split cushion supports 22 and 24 not only cushion hand 26 from foundational connector 20 from the underside but folds 54 and 56 also cushion hand 26 against the top edge of foundational connector 20. This prevents foundational connector 20 from digging into the back of hand 26 as weight lifting support and cushion device 10 is pulled toward the fingers of hand 26 under load when device 10 is wrapped and locked around exercise bar 28 and tightened against hand 26.

Split cushion supports 22 and 24 are separated along foundational connector 20 in order to provide a system wherein foundational connector 20 is essentially supported on the bones located on the sides of the back of the wrist of hand 26. As can be seen in FIG. 4, split cushion support 24 supports foundational connector 20 and distributes pressure derived from the weight of exercise bar 28 on the portion of the wrist of hand 26 where the protruding portion of the radius bone of the arm connects to the bones of the wrist. On the opposite side (not shown), split cushion support 22 provides support to foundational connector 20 and distributes pressure on the protruding portion of the wrist of hand 26 where the ulna of the arm connects to the bones of the wrist. In this way, split cushion supports 22 and 24 provide a system where support is derived from the substantial bone portions of the back of the wrist rather than the smaller carpal bones or flesh of the wrist. Split cushion supports 22 and 24 also provide a system wherein the back of the wrist of hand 26 is protected and cushioned from being pinched or stretched by foundational connector 20.

FIGS. 6, 7, and 8 show the manner in which recoil tip 18 of weight lifting support and cushion device 10 is constructed. Recoil tip 18 in the preferred embodiment is a five (5) layer roll which allows weight lifting support and cushion device 10 and thereby hand 26 to be secured or locked to exercise bar 28. The cushion recoil tip also presses into the base of the palm of the hand so as to assist in supporting the weight of exercise bar 28 so as to brace and lock exercise bar 28 into hand 26.

Referring to FIG. 6, an isometric view of the construction of recoil tip 18, double overlay straps 12 and 14 are shown folded over one end of a cover strip 60. Cover strip 60 interlocks with double overlay straps 12 and 14 in the construction of recoil tip 18. A fold stitch 62 sews double overlay straps 12 and 14 and cover strip 60 together. Cover strip 60 in the preferred embodiment is a length of cotton webbing approximately 3 inches long and 1½ inches wide although it is understood that cover strip 60 could suitably vary in length as required in order to vary the size of recoil tip 18.

Referring to FIG. 7, the second ends 64 and 66 of double overlay straps 12 and 14, respectively, are rolled back toward and in contact with fold stitch 62 (shown in FIG. 6) to form roll 63. Cover strip 60 is then folded over the roll 63 created by second ends 64 and 66.

Referring to FIG. 8, an isometric view of FIG. 7, cover strip 60 is folded over roll 63 created by second ends 64 and 66 and secured by a cover strip stitch 68. The excess length of cover strip 60 is then cut off and discarded, and the assembly of recoil tip 18 is complete.

The shape of recoil tip 18 allows weight lifting support and cushion device 10 to be locked onto exercise bar 28 (of FIG. 3) and also facilitates gripping of exercise bar 28 by hand 26. The fingers of hand 26 press against the doubled section 70 of recoil tip 18 while the bottom roll 63 contacts the lower palm of hand 26 to maintain weight lifting support and cushion device 10 tightly locked to exercise bar 28.

While the invention has been described with a certain degree of particularity, it is manifest that many changes may be made in the details of construction and materials of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A support and cushion device for assisting a user's hand, in grasping an exercise device wherein the user's hand includes a back, palm, heel and ball of the thumb, comprising:

a double overlay strap having a first end and a second end;

said first end of said double overlay strap connected to said second end of said double overlay strap thereby forming a first length of said double overlay strap and a second length of said double overlay strap;

a foundational connector including a first end and a second end;

said first end and said second end separated by a section of said foundational connector;

said first end of said foundational connector folded around said first length of said double overlay strap an d secured to said section forming a first looped end;

said second end of said foundational connector folded around said second length of said double overlay strap and secured to said section forming a second looped end; said foundational connector bisected to form a first segment and a second segment;

said first segment terminating with said first looped end and said second segment terminating with said second looped end;

said first length of said double overlay strap extending through said first looped end and said second length of said double overlay strap extending through said second looped end such that said first segment is substantially perpendicular to said first length and said second segment is substantially perpendicular to said second length; and, said first segment slidingly engaging said first length and said second segment slidingly engaging said second length whereby when the back of the user's hand engages said section of said foundational connector, said first looped end is on the ball of the thumb and adjacent said second looped end on the heel of the user's hand and said first and second lengths of said double overlay strap engage the exercise device to assist the user's grasp.

2. The support and cushion device of claim 1 wherein said first end of said double overlay strap and said connected second end of said double overlay strap are rolled to form a recoil tip.

3. The support and cushion device of claim 1 wherein said first end of said double overlay strap and said connected second end of said double overlay strap are rolled inside a cover strip to form a recoil tip.

4. The support and cushion device of claim 1 wherein said foundational connector includes at least one cushion thereon.

5. The support and cushion device of claim 1 wherein said double overlay strap is substantially bisected forming a first terminal end and a second terminal end;

a prop brace affixed to said first terminal end and said second terminal end.

6. A support and cushion device for assisting a user in grasping a gripable object, comprising:

a flexible double overlay strap having a first end and a second end;

said first end of said double overlay strap is connected to said second end of said double overlay strap thereby forming a first length of said double overlay strap and a second length of said double overlay strap;

said first end of said double overlay strap and said second end of said double overlay strap is rolled to form a recoil tip;

a flexible foundational connector including a first looped end and a second looped end;

said foundational connector including a first segment and a second segment;

said first segment terminating with said first looped end and said second segment terminating with said second looped end;

said first length of said double overlay strap extending through said first looped end and said second length of said double overlay strap extending through said second looped end such that said first segment is substantially perpendicular to said first length and said second segment is substantially perpendicular to said second length, and;

said first segment slidingly engaging said first length and said second segment slidingly engaging said second length;

whereby with the back of the user's hand engaging said foundational connector, said first and second lengths of said double overlay strap shall engage the gripable object to assist the user'grasp.

7. The support and cushion device of claim 6 wherein said foundational connector includes at least one cushion thereon.

8. The support and cushion device of claim 6 wherein said first end of said double overlay strap and said connected second end of said double overlay strap are rolled inside a cover strip to form said recoil tip.

9. The support and cushion device of claim 6 wherein said double overlay strap is substantially bisected forming a first terminal end and a second terminal end;

a prop brace affixed to said first terminal end and said second terminal end.

10. A weight lifting support and cushion device, comprising:

a first flexible double overlay strap having a first end and a second end;

a second flexible double overlay strap having a first end and a second end;

said first end of said first double overlay strap and said first end of said second double overlay strap is rolled inside a cover strip and secured to form a recoil tip;

a prop brace;

said second end of said first double overlay strap and said second end of said second double overlay strap is secured to said prop brace;

a flexible foundational connector including a first looped end and a second looped end;

said foundational connector including a first segment and a second segment;

said first segment terminating with said first looped end and said second segment terminating with said second looped end;

said first double overlay strap extending through said first looped end and said second double overlay strap extending through said second looped end such that said first segment is substantially perpendicular to said first double overlay strap and said second segment is substantially perpendicular to said second double overlay strap; and said foundational connector slidingly engaging the lengths of said double overlay straps;

whereby the back of the user's hand is cushioned and supported by said foundational connector.

11. The weight lifting support and cushion device of claim 10 wherein said foundational connector includes at least one cushion thereon.

12. The weight lifting support and cushion device of claim 11 wherein a first cushion is secured along said first segment of said foundational connector and a second cushion is secured along said second segment of said foundational connector.

* * * * *